United States Patent [19]

Kühnert

[11] Patent Number: 5,053,321

[45] **Date of Patent: * Oct. 1, 1991**

[54] GRANULATED COLOUR PHOTOGRAPHIC BLEACHING AGENT AND ITS PREPARATION

[75] Inventor: Peter Kühnert, Leverkusen, Fed. Rep. of Germany

[73] Assignee: Agfa Gevaert Aktiengesellschaft, Leverkusen, Fed. Rep. of Germany

[ * ] Notice: The portion of the term of this patent subsequent to May 8, 2007 has been disclaimed.

[21] Appl. No.: 537,437

[22] Filed: Jun. 13, 1990

[30] Foreign Application Priority Data

Jun. 27, 1989 [DE] Fed. Rep. of Germany ..... 3920921

[51] Int. Cl.[5] ..... G03C 5/44

[52] U.S. Cl. ..... 430/450; 430/461; 430/462; 430/465; 430/393

[58] Field of Search ..... 430/450, 461, 465, 393, 430/462

[56] References Cited

U.S. PATENT DOCUMENTS

| | | | |
|---|---|---|---|
| 2,843,482 | 7/1958 | Kridel | 96/60 |
| 4,923,785 | 5/1990 | Frank | 430/430 |
| 4,923,786 | 5/1990 | Kuhnert et al. | 430/450 |

*Primary Examiner*—Charles L. Bowers, Jr.
*Assistant Examiner*—Tanis L. Dote
*Attorney, Agent, or Firm*—Connolly & Hutz

[57] ABSTRACT

Color photographic bleaching agent containing, in the form of a granulate having an average particle diameter of from 150 to 3000 μm, an iron (III) complex or an iron (III) complex salt and a rehalogenating agent is dust free and freely pourable, will keep indefinetely and dissolves in water at 25° C. within 45 seconds to form a solution ready for use.

3 Claims, No Drawings

GRANULATED COLOUR PHOTOGRAPHIC BLEACHING AGENT AND ITS PREPARATION

This invention relates to a granulated colour photographic bleaching agent and to a process for the preparation of such a bleaching agent which will dissolve rapidly.

Colour photographic bleaching agents conventionally contain numerous solid, water soluble constituents, e.g. the bleaching substance proper, rehalogenating agents, complex formers, alkali donors and corrosion protective agents. These bleaching agents may suitably be made up into powders and liquid concentrates, the latter having become increasingly more widely used in the course of the years as they can be dosed more easily than powders. On the other hand, liquid preparations have the disadvantage of being loaded with water, which causes additional costs.

It is an object of the present invention to provide a solid form of preparation of a colour photographic bleaching agent which can easily be dosed and is rapidly soluble.

This problem is solved with bleaching agents in a granular form with an average particle diameter of the granulate of from 150 to 3000 μm.

The invention thus relates to a colour photographic bleaching agent containing, in the form of a granulate having an average particle diameter of from 150 to 3000 μm, an iron(III) complex or an iron(III) complex salt and a rehalogenating agent.

The granulates may also contain corrosion protective agents such as sodium nitrate, complex formers such as ethylene diaminotetracetic acid (EDTA), propylene diaminotetracetic acid (PDTA), diethylene triaminopentacetic acid (DTPA) or nitro acetic acid (NTA) and agents for adjusting the pH, e.g. sodium carbonate.

The Fe(III) complexes and complex salts may be Fe(III) complexes and Fe(III) complex salts of EDTA, PDTA, DTPA or NTA, e.g. the alkali metal and ammonium complex salts thereof, in particular sodium and $NH_4$ complex salts. The rehalogenating agents used may be alkali metal or ammonium halides, e.g. NaBr, KBr, $NH_4Br$ or NaCl.

The iron(III) complex or iron(III) complex salt preferably constitutes from 20 to 50% by weight of the fabricated granulate while the rehalogenating agent preferably constitutes from 40 to 70% by weight of the granulate.

It has been found that this granulated composition may be prepared by mixing all the solid constituents and milling the mixture so that the particle diameter distribution curve has its maximum below 10 μm, and then subjecting the milled particles to a powder agglomeration and drying the granulates in a vacuum.

This invention thus relates to a process for the preparation of a granulated preparation of solid constituents of a colour photographic bleaching agent, characterised in that the solid constituents of the bleaching agent are mixed together, milled to a particle size of less than 10 μm and then subjected to a powder agglomeration, optionally with the addition of a granulating liquid and a binder, and dried in a vacuum.

The resulting granulates of the solid constituents of a colour photographic bleaching agent are mechanically stable and uniform in particle size, dissolve rapidly and keep indefinitely and are dust free and freely pourable.

The size reduction of solid constituents to particle sizes below 10 μm is normally carried out by jet milling. Powder agglomeration is preferably carried out in a fluidized bed, a granulating liquid, e.g. 200 ml of water per kg of powder, and some binder, e.g. corn starch, being optionally added to the particles to be agglomerated.

EXAMPLE

Bleaching bath granulate for the processing of colour negative films.

The following chemicals were mixed together for the preparation of a granulate for 10 liters of solution of bleaching bath replenisher ready for use:

| | | |
|---|---|---|
| 1. | iron-ammonium-EDTA | 1,200 g |
| 2. | ammonium bromide | 1,650 g |
| 3. | sodium nitrate | 200 g |
| 4. | EDTA acid | 25 g |
| 5. | ammonium carbonate | 37 g. |

The mixture is milled in an air jet mill until the average particle diameter of the milled product has been reduced to 5 μm.

The milled material is granulated in portions of about 600 gram in a commercial fluidized layer granulator (Strea 1-Laboratory Apparatus of Aeromatic, Bubendorf/Switzerland).

The milled material is sprayed with 130 ml of water as granulating liquid in 3 minutes. This spraying must be carried out in several intervals to ensure uniform grain size distribution.

After granulation, the product is dried for 4–5 minutes in the same apparatus by heating the fluidizing air to 60° C. Small quantities of oversized grain larger than 2 mm are removed by sifting. The granulate is then dried again in a vacuum at room temperature for 90 minutes.

The granulate is dust free, freely pourable and yellow-brown in colour. It dissolves in water at 25° C. within about 45 seconds with stirring to form a clear, dark red solution. 311 gramme of granulate are required for preparing 1 liter of solution ready for use.

The granulate is identical in its photographic properties to a product which has not been granulated.

When sealed in an aluminium laminated bag, it will keep indefinitely.

I claim:

1. Colour photographic bleaching agent containing, in the form of a granulate having an average particle diameter of from 150 to 3000 μm, an iron(III) complex or an iron(III) complex salt and a rehalogenating agent.

2. Colour photographic bleaching agent according to claim 1, in which the iron(III) complex or the iron(III) complex salt constitutes from 20 to 50% by weight of the fabricated granulate and the rehalogenating agent constitutes from 40 to 70% by weight of this granulate.

3. A process for the preparation of a granulated preparation of the solid constituents of a colour photographic bleaching agent, characterised in that the solid constituents of the bleaching agent are mixed together, milled to a particle size of less than 10 μm, then subjected to a powder agglomeration, optionally with the addition of a granulating liquid and a binder, and dried in a vacuum.

* * * * *